US008783658B2

(12) United States Patent
Haeberle

(10) Patent No.: US 8,783,658 B2
(45) Date of Patent: Jul. 22, 2014

(54) TELESCOPIC STRUCTURAL SUPPORT

(75) Inventor: Wilfried Haeberle, Langenau (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 13/515,308

(22) PCT Filed: Dec. 8, 2010

(86) PCT No.: PCT/EP2010/069151
§ 371 (c)(1),
(2), (4) Date: Jun. 12, 2012

(87) PCT Pub. No.: WO2011/073064
PCT Pub. Date: Jun. 23, 2011

(65) Prior Publication Data

US 2012/0248391 A1 Oct. 4, 2012

(30) Foreign Application Priority Data

Dec. 14, 2009 (DE) ..... 10 2009 054 627

(51) Int. Cl.
*B66F 3/10* (2006.01)

(52) U.S. Cl.
USPC ..... 254/102; 254/98; 254/100

(58) Field of Classification Search
USPC ..... 254/98, 100, 102
See application file for complete search history.

(56) References Cited

U.S. PATENT DOCUMENTS

| | | | | |
|---|---|---|---|---|
| 3,229,950 | A * | 1/1966 | MacRobbie | 248/354.5 |
| 4,083,156 | A * | 4/1978 | Tye | 248/354.5 |
| 2002/0073634 | A1 | 6/2002 | Bolinger | |

FOREIGN PATENT DOCUMENTS

| | | |
|---|---|---|
| CN | 2729221 | 9/2005 |
| CN | 2736467 | 10/2005 |
| CN | 2755224 | 2/2006 |
| CN | 201245981 | 5/2009 |
| DE | 72142 | 4/1970 |
| DE | 2 231 964 | 1/1974 |
| DE | 32 39 104 | 4/1984 |
| DE | 195 11 684 | 10/1996 |
| DE | 195 03 298 | 2/1997 |
| FR | 1 038 340 | 9/1953 |
| FR | 1 310 595 | 11/1962 |
| FR | 2 222 870 | 10/1974 |
| GB | 885 002 | 12/1961 |
| JP | 2003-130018 | 5/2003 |

* cited by examiner

*Primary Examiner* — Lee D Wilson
*Assistant Examiner* — Shantese McDonald
(74) *Attorney, Agent, or Firm* — Paul Vincent

(57) ABSTRACT

A telescopic push-pull prop 10 for the construction industry has an outer tube 12 and at least one threaded rod or inner tube 14. An outer thread 22 of the inner tube 14 engages with an inner thread 24 of the outer tube 12. The inner thread 24 of the outer tube 12 is arranged at an axial separation from a free end 26 of the outer tube 12. The inner thread 24 of the outer tube 12 is produced by an at least partially circumferential reduction of the outer tube 12 over a mandrel positioned in the outer tube 12, the mandrel having an outer thread. At its free end 26, the outer tube 12 has an edge section 34 with a pass-through cross-section 32' that is reduced with respect to a nominal width 36 of the outer tube.

11 Claims, 3 Drawing Sheets

TELESCOPIC STRUCTURAL SUPPORT

This application is the national stage of PCT/EP2010/069151 filed on Dec. 8, 2010 and also claims Paris Convention priority of DE 10 2009 054 627.8 filed on Dec. 14, 2009.

BACKGROUND OF THE INVENTION

The invention concerns a telescopic push-pull prop for the construction industry, comprising an outer tube and at least one threaded rod or inner tube, which is disposed in the outer tube such that it can be axially adjusted therein and an outer thread of which engages with an inner thread of the outer tube.

Push-pull props of this type are used in the building industry to align wall formworks for concrete walls and secure them against any possible wind loads or other transverse loads that might occur during construction operation.

At both of their ends, the push-pull props normally have threaded rods that engage with inner threads of the outer tube, which run in an opposite direction thereto. During operation, the threaded rod of one end is thereby tightened in a torque-proof fashion on a firm support, whereas the threaded rod at the other end of the push-pull prop engages with a formwork element or the like to be supported. The length of the push-pull prop is adjusted by corresponding rotation of the outer tube in relation to the rotationally fixed threaded rods.

The respective inner thread of the outer tube of these push-pull props is either produced by a threaded nut that is welded to the respective end of the outer tube, or by tapering the respective end and simultaneously impressing the thread, or by subsequent machining of the outer tube.

In view of the conditions of use of the push-pull props, the area of the inner thread is often soiled, e.g. by fresh concrete, which can result in malfunction or increased wear of the thread of the push-pull prop. In addition thereto, the mechanical load that cannot be prevented during operation sometimes directly damages the inner thread which can result in failure of the push-pull prop.

It is the underlying purpose of the invention to present a push-pull prop of this kind, which is better protected against soiling and damage and at the same time can be produced at low cost.

SUMMARY OF THE INVENTION

This object is achieved in accordance with the invention in that the inner thread of the outer tube is disposed at an axial distance from a free end of the outer tube, associated with the inner tube, wherein the inner thread of the outer tube is produced by an at least partially circumferential reduction of the outer tube over a mandrel positioned in the outer tube, the mandrel comprising an outer thread, wherein the free end of the outer tube has an edge section having a reduced pass-through cross-section relative to a nominal width of the outer tube.

The inventive positioning of the inner thread improves protection thereof against direct damage during operation or transport, at the same time counteracting entry of soiling, such as e.g. fresh concrete, into the area of the thread engagement, thereby reducing the danger of blocking and excessive thread wear. The inner thread including the inventively designed edge area of the outer tube can moreover be produced in only one work step, whereby the reduced tube section is reinforced with a largely maintained wall thickness, and has a high surface quality which is advantageous for the loading capacity and ease of movement of the thread. Expensive welding work or machining of the outer tube is no longer required. The edge section can furthermore be ergonomically formed, which reduces the danger of injuries during handling of the push-pull prop.

In one embodiment of the invention, the inner thread is protected with particular efficiency in that the overall circumference of the pass-through cross-section of the edge section is reduced and spaced apart from the outer diameter of the threaded rod or the inner tube.

In accordance with a preferred further development of the invention, the pass-through cross-section of the edge section may be concentrically reduced compared to the nominal width of the outer tube.

In accordance with embodiments of the invention, the pass-through cross-section of the edge section may additionally conically and/or gradually taper in an axial direction.

The loading capacity of the edge section at the threaded-side end of the outer tube may be further increased by providing the edge section, at least in parts, with an axially curved, i.e. cambered, outer lateral surface. This additionally enables particularly safe handing of the push-pull prop, i.e. with little risk of injury.

The edge section of the outer tube may also have a curved edge, wherein the edge is advantageously doubled in order to further increase the stability of the edge section of the outer tube.

In order to improve the effectiveness of sealing of the gap between the edge section of the outer tube and the threaded rod or the inner tube with respect to entry of soiling, in accordance with the invention, the edge section may comprise at least one sealing element that advantageously abuts the inner tube. The sealing element advantageously has an annular design and is arranged at the free edge of the outer tube, in particular, like a cap. The sealing element may be designed as a rubber-elastic element or as a brush element, which is suitable with respect to frictional resistance.

In order to reinforce the push-pull prop with respect to the action of bending forces, the inner thread of the outer tube is advantageously interrupted by several e.g. web-shaped intermediate webs, which define an inner diameter of the outer tube, which is larger than the pass-through cross-section of the inner thread.

The inner and/or outer tubes are advantageously produced from steel or a steel alloy and/or from a light metal and may each be designed as a round profile or an edge profile.

It is clear that the outer lateral surface may have polygonal cross-sectional shapes. The free ends of the outer tube may be recessed to different degrees with respect to the inner tube or the inner rod such that there are different gap widths between the outer tube and the inner tube or inner rod.

Further advantages and advantageous embodiments of the subject matter of the invention can be extracted from the description, the drawing and the claims.

DESCRIPTION OF THE PREFERRED EMBODIMENT

Figure 1:
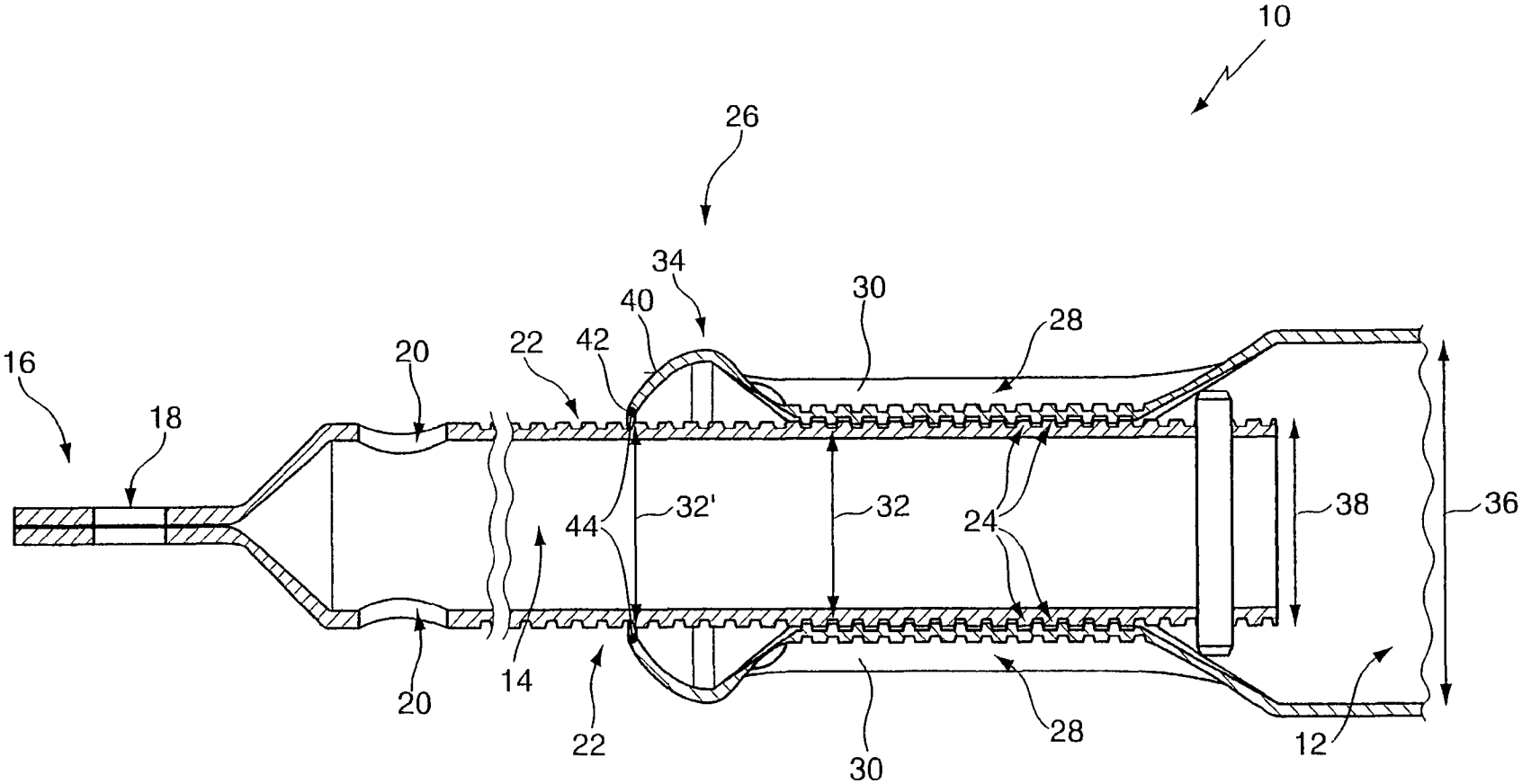
FIG. 1 shows a longitudinal section through a selected area of an inventive push-pull prop.

FIG. 1 shows a longitudinal section through a selected area of an inventive telescopic push-pull prop 10 for the construction industry. The push-pull prop 10 has an outer tube 12 and an inner tube 14 which is arranged in the outer tube such that it can be axially adjusted therein. The outer tube and the inner tube 12, 14 are each designed as a round profile. The inner tube 14 has a free end 16, designed as a mounting flange, with an insertion opening 18 for a pin (not shown in detail) by means of which the inner tube 14 can be mounted e.g. in an opening of a wall formwork. The inner tube 14 moreover has two oppositely arranged recesses 20 for a further pin.

The inner tube 14 has an outer thread 22 that engages with an inner thread 24 of the outer tube 12. When the inner tube 14 is rotated with respect to the outer tube 12, the inner tube 14 may be moved like a spindle out of or into the outer tube 12 in dependence on the direction of rotation.

The inner thread 24 of the outer tube 12 is arranged axially spaced apart from a free end 26 of the outer tube 12, associated with the inner tube 14, and has a total of four groove-shaped threaded sections 28, which are uniformly distributed over its circumference, and of which only two are shown in FIG. 1 due to the section.

The inner thread 24 is produced by an at least partially circumferential reduction of the outer tube 12 over a mandrel which is positioned in the outer tube 12 during the production process and has an outer thread. In the present embodiment, four grooves that are uniformly distributed over the circumference and have threaded ridges arranged in the respective groove bottom were e.g. impressed in the wall of the outer tube 12, wherein the wall of the outer tube 12 was pressed onto the mandrel and shaped into each groove-shaped threaded section 28. The outer tube 12 may also have more or less than four groove-shaped threaded sections 28.

Figure 2:
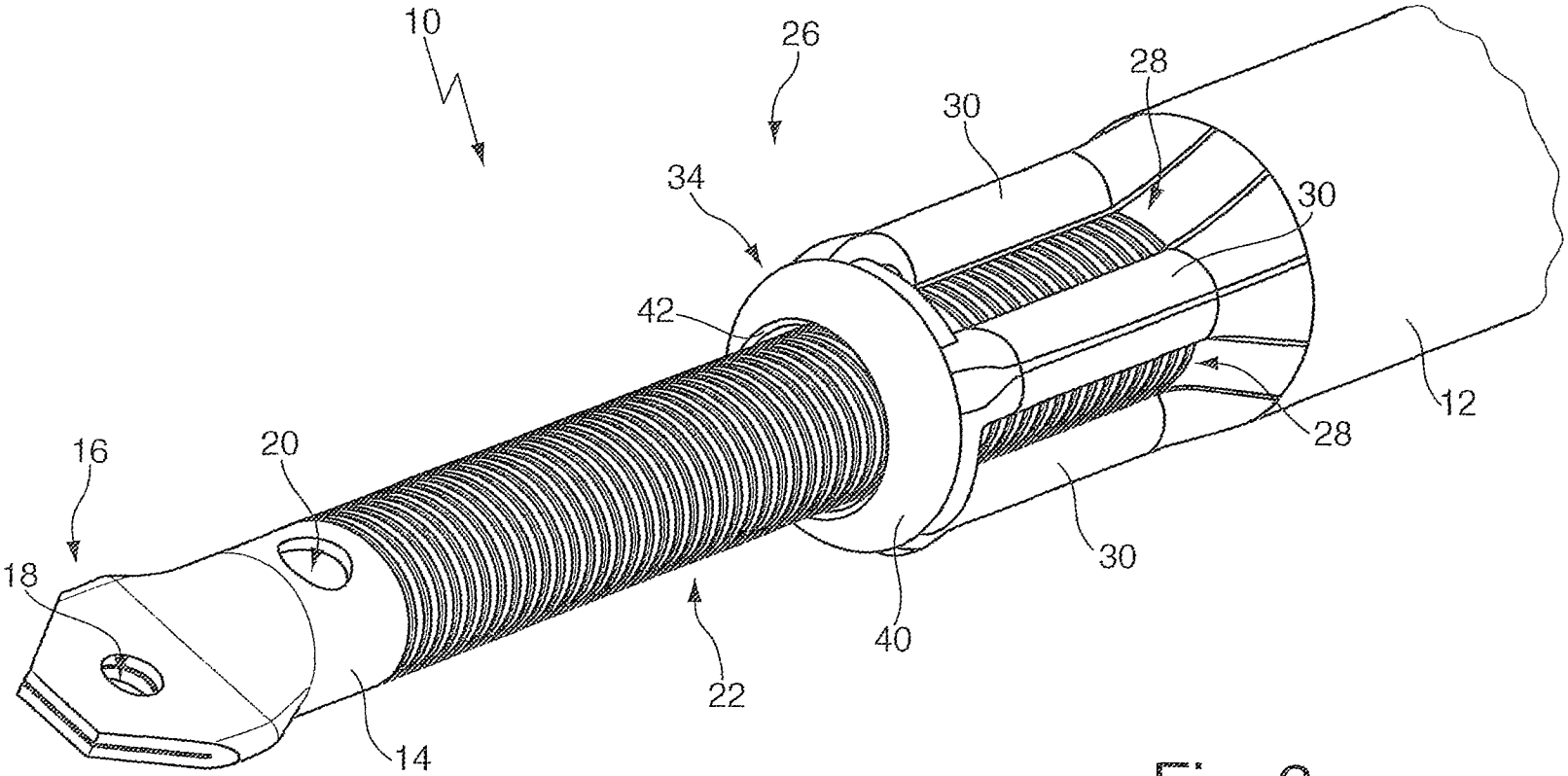
FIG. 2 shows a perspective view of the push-pull prop of FIG. 1.
Figure 3:
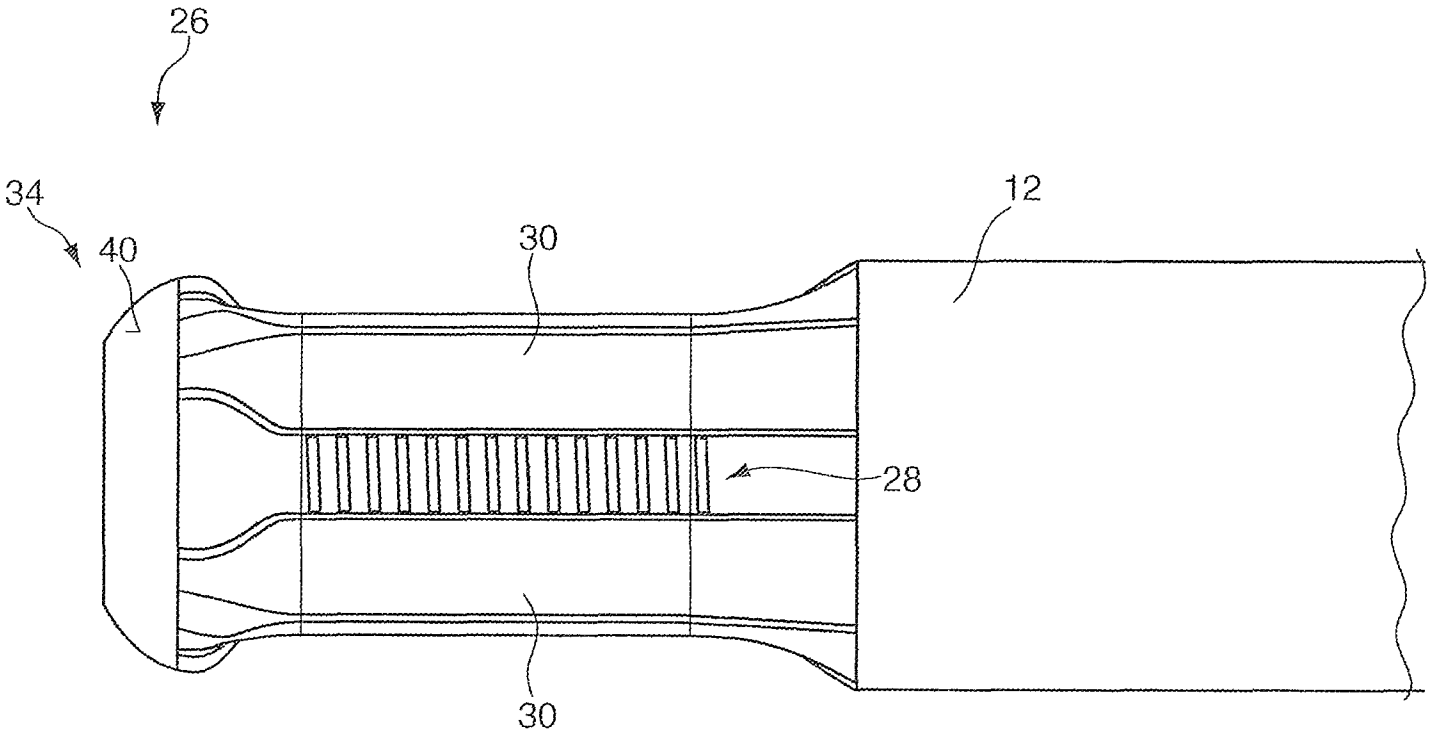
FIG. 3 shows a side view of a section of an outer tube of the push-pull prop shown in FIG. 1.

As is illustrated, in particular, in FIGS. 2 and 3, web-shaped intermediate areas 30 are disposed between each of the groove-shaped threaded sections 28 of the inner thread 24, and define an inner diameter that is larger than a pass-through cross-section 32 of the inner thread 24 of the outer tube 12 and project in a radial direction past a circumferential line defined by the groove-shaped threaded sections 28. The intermediate areas 30 are primarily used to reinforce the outer tube 12, i.e. they counteract deformation of the outer tube 12 in the area of the inner thread 24 and provide additional protection against direct mechanical damage to the inner thread 24 from the outside.

The free end 26 of the outer tube 12 facing the inner tube 14 is furthermore provided with an edge section 34, the pass-through cross-section 32' (cf. FIG. 1) of which is concentrically reduced over the full circumference with respect to a nominal width 36 of the outer tube 12 and tapered to the outer diameter 38 of the inner tube 14.

The end face of the edge section 34 is provided with an axially curved and rotationally symmetrical outer lateral surface 40, which i.a. minimizes the danger of injuries during handling of the push-pull prop 10.

In accordance with embodiments of the invention, which are not shown in detail in the drawing, the pass-through cross-section 32' of the edge section 34 of the outer tube 12 may taper conically and/or gradually in an axial direction. The edge section 34 may also have a bent and, if necessary, doubled edge 42.

The edge section 34 of the outer tube 12 moreover has an annular rubber-elastic sealing element 44 disposed at the edge 42 of the outer tube. In accordance with an embodiment, which is not shown in detail, the sealing element 44 may be designed as a brush element, wherein the free ends of each brush project in a radial direction towards the inner tube past the edge section and at least partially lie against the inner tube. The sealing element 44 may also be designed as a rubber-elastic element and may be produced e.g. from plastic material.

In accordance with an embodiment that is not illustrated in more detail in the drawing, the push-pull prop 10 may also comprise a second axially adjustable inner tube 14 which is arranged in the area of the other free end of the outer tube 12 in a fashion corresponding to the above embodiment. The respective inner threads 24 of the correspondingly designed outer tube 12 run in opposite directions in this case.

The invention concerns a telescopic push-pull prop 10 for the construction industry, comprising an outer tube 12 and at least one threaded rod or inner tube 14, which is arranged in the outer tube such that it can be axially adjusted therein. An outer thread 22 of the inner tube 14 engages with an inner thread 24 of the outer tube 12. In accordance with the invention, the inner thread 24 of the outer tube 12 is arranged at an axial separation from a free end 26 of the outer tube 12, associated with the inner tube 14, wherein the inner thread 24 of the outer tube 12 is produced by an at least partially circumferential reduction of the outer tube 12 over a mandrel positioned in the outer tube 12, the mandrel comprising an outer thread. At its free end 26, the outer tube 12 has an edge section 34 with a pass-through cross-section 32' that is reduced with respect to a nominal width 36 of the outer tube 12.

I claim:

1. A telescopic push-pull prop for construction industry, the push-pull prop comprising:

an outer tube having a free end, a web and an inner thread disposed at an axial separation from said free end, said inner thread having a first inner thread section and a second inner thread section separated from said first inner thread section by said web, said web thereby extending in an axial direction of said outer tube between said first and said second inner thread sections, wherein said free end of said outer tube comprises an edge section having a pass-through cross-section that is reduced with respect to a nominal width of said outer tube; and at least one threaded rod or threaded inner tube disposed in said outer tube for axial adjustment therein, said inner tube having an outer thread which engages with said first and said second inner thread sections of said outer tube.

2. The push-pull prop of claim 1, wherein said pass-through cross-section of said edge section is tapered down over a full circumference to an outer diameter of said inner tube.

3. The push-pull prop of claim 1, wherein said pass-through cross-section of said edge section is concentrically tapered.

4. The push-pull prop of claim 1, wherein said pass-through cross-section of said edge section conically tapers in an axial direction.

5. The push-pull prop of claim 1, wherein said pass-through cross-section of said edge section gradually tapers in an axial direction.

6. The push-pull prop of claim 1, wherein at least part of said edge section has an axially curved outer lateral surface.

7. The push-pull prop of claim 1, wherein said edge section has a bent edge.

8. The push-pull prop of claim 1, wherein said edge section has at least one sealing element.

9. The push-pull prop of claim 8, wherein said sealing element lies against said inner tube.

10. The push-pull prop of claim 8, wherein said sealing element is a brush sealing element.

11. The push-pull prop of claim 1, wherein said outer tube is an edge profile.

* * * * *